US006523690B1

(12) United States Patent
Buck et al.

(10) Patent No.: US 6,523,690 B1
(45) **Date of Patent: *Feb. 25, 2003**

(54) WET WIPE CONTAINER WITH FLEXIBLE ORIFICE

(75) Inventors: Frederick Allan Buck, Neenah, WI (US); Andrew Kuo, Appleton, WI (US); Yvette Lynn Hammonds, Fond du Lac, WI (US); John David Amundson, Crawley (GB)

(73) Assignee: Kimberly-Clark Worldwide, Inc., Neenah, WI (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/538,711

(22) Filed: Mar. 30, 2000

(51) Int. Cl.[7] ..... B65D 73/00
(52) U.S. Cl. ..... 206/494; 221/63
(58) Field of Search ..... 206/207, 209, 206/210, 494, 812; 221/34, 35, 38, 45, 48–54, 63, 64; 225/106

(56) References Cited

U.S. PATENT DOCUMENTS

| | | | | |
|---|---|---|---|---|
| 2,004,614 A | | 6/1935 | Meagher | |
| 3,095,991 A | | 7/1963 | Paniagua | |
| 3,239,097 A | | 3/1966 | Bates et al. | |
| 3,369,699 A | | 2/1968 | Enloe et al. | |
| 3,749,296 A | | 7/1973 | Harrison | |
| 3,780,908 A | * | 12/1973 | Fitzpatrick et al. | 206/494 |
| 3,836,044 A | * | 9/1974 | Tilp et al. | 206/494 |
| 3,868,052 A | | 2/1975 | Rockefeller | |
| 3,979,019 A | | 9/1976 | Bliss | |
| 3,994,417 A | | 11/1976 | Boedecker | |
| 4,004,687 A | | 1/1977 | Boone | |

(List continued on next page.)

FOREIGN PATENT DOCUMENTS

| | | |
|---|---|---|
| EP | 0 068 722 B1 | 4/1988 |
| EP | 0 331 027 B1 | 1/1992 |
| EP | 0 744 357 A1 | 11/1996 |
| EP | 0 644 130 B1 | 5/1998 |
| GB | 793745 | 4/1958 |
| WO | WO 99/55599 A1 | 11/1999 |

OTHER PUBLICATIONS

American Society for Testing Materials (ASTM) Designation: D 412–98a "Standard Test Methods for Methods for Vulcanized Rubber and Thermoplastic Elastomers—Tension[1]" pp. 43–55, published Aug. 1998.

American Society for Testing Materials (ASTM) Designation: D 790–99 "Standard Test Methods for Flexural Properties of Unreinforced and Reinforced Plastics and Electrical Insulating Materials[1]" pp. 150–158, published Feb. 2000.

American Society for Testing Materials (ASTM) Designation: D 2240–97$^{e1}$ "Standard Test Method for Rubber Property—Durometer Hardness[1]" pp. 400–403, published Mar. 1997.

American Society for Testing Materials (ASTM) Designation: D 6125–97 "Standard Test Method for Bending Resistance of Paper and Paperboard (Gurley Type Tester)[1]" pp. 885–889, published Feb. 1998.

*Primary Examiner*—Luan K. Bui
(74) *Attorney, Agent, or Firm*—Michael J. Bendel; Gregory E. Croft

(57) ABSTRACT

A container for wet wipes includes a pop-up style dispensing means formed by a rigid port which surrounds a flexible, rubber-like material or sheet having one or more slits through which the wet wipes are dispensed. The configuration of the slits, in combination with the flexibility of the rubber-like material, enables the user to reach into the container through the slits to grasp a wet wipe in the event the pop-up feature fails, either due to fallback or a missed interfold.

15 Claims, 3 Drawing Sheets

U.S. PATENT DOCUMENTS 4,017,002 A 4/1977 Doyle et al.
4,133,457 A 1/1979 Klassen
4,180,160 A 12/1979 Ogawa et al.
4,200,200 A 4/1980 Hein, III et al.
4,289,262 A 9/1981 Finkelstein
4,337,876 A 7/1982 Thompson
4,681,240 A 7/1987 Wyant
4,784,290 A 11/1988 Howard
4,848,575 A * 7/1989 Nakamura et al. ..... 206/494
5,542,567 A * 8/1996 Julius ..... 221/63
5,704,471 A 1/1998 Yamada
5,729,955 A * 3/1998 Yamad ..... 206/494
D395,952 S 7/1998 Buczwinski et al.
5,785,179 A 7/1998 Buczwinski et al.
5,908,138 A * 6/1999 Vlahadis et al. ..... 221/63
D414,637 S 10/1999 Amundson et al.
6,053,357 A 4/2000 Yoh
6,152,322 A 11/2000 Marino
6,182,858 B1 * 2/2001 Hartog ..... 221/63

* cited by examiner

WET WIPE CONTAINER WITH FLEXIBLE ORIFICE

BACKGROUND OF THE INVENTION

A wide variety of wet wipes dispensing containers are available in the market today. These containers may be broadly categorized into two classes: reach-in and pop-up. Within the pop-up category, some containers provide a stack of flat wipes, which are interfolded, which are most commonly dispensed from a tub. Other containers provide a roll of wipes, perforated at their edges, which are dispensed from an upright cylindrical container. The pop-up style containers have gained popularity because the wet wipe is more readily available to the user. Although there is a greater opportunity for the wipes in a pop-up style container to at least partially dry out, improvements in container design have mitigated this problem.

However, for pop-up style containing a stack of wipes there are occasions where the pop-up feature fails and the user needs to reach into the container to retrieve the next wipe. These failures are most often caused by missed interfolds. Unfortunately, current pop-up containers do not have openings that enable the user to reach into the container, while at the same time maintaining a sufficiently good seal to prevent substantial dry-out of the wipe s within the container.

SUMMARY OF THE INVENTION

It has now been discovered that certain pop-up style wet wipe containers can provide simultaneous pop-up and reach-in capability. This is not only useful for retrieving wipes that failed to dispense, but it also enables users to push the popped-up wipe back into the container to improve moisture retention or to more readily maintain sanitary conditions, and thereafter easily retrieve the wipe.

Hence in one aspect, the invention resides in a wet wipe container containing interfolded or perforated wet wipes and having a pop-up style dispensing means positioned beneath a retractable lid, said dispensing means comprising a rigid port surrounding a flexible, rubber-like material or sheet having one or more slits through which individual wet wipes are removed from the container when the lid is open, wherein the flexibility of the sheet and the length of the slit(s), in combination, are sufficient to enable a user to reach into the container and easily retrieve a wet wipe in the event the pop-up feature fails.

In another aspect, the invention resides in a wet wipe container containing interfolded or perforated wet wipes and having a pop-up style dispensing means positioned beneath a retractable lid, said dispensing means comprising a rigid port surrounding a flexible, rubber-like material or sheet having one or more slits through which individual wet wipes are removed from the container when the lid is open, wherein the dispensing means has a Penetration Index of from about 50 to about 600 grams.

For purposes herein, the "container" can be any container suitable for storing and dispensing wet wipes including, but not limited to, tubs, canisters, soft packs, and the like.

The configuration and the length of the slit(s) in the flexible, rubber-like material or sheet can vary giving consideration to a number of factors, including evaporation losses, ease of wipe removal, sufficient frictional engagement to maintain the pop-up feature and access to the wipes within the container in the event the pop-up feature fails. It has been found that multiple intersecting slits works well to meet all of the foregoing considerations. This will be described in more detail with reference to the Drawings.

The nature of the flexible, rubber-like material or sheet having the slits must be sufficiently stiff to maintain a reasonable impediment to evaporation losses and to hold the wet wipes in the pop-up position. At the same time, it must be pliable enough and elastic in order to enable the user to reach into the container with the fingers sufficiently far, without hurting his/her fingers, to grasp a wipe from the top of the stack, even when the stack is down to one remaining wipe. To meet these requirements, the properties of the flexible, rubber-like sheet combine with the selected slit configuration to attain the desired end result. It will be appreciated that as the length of the slits increases, it becomes easier to reach one's finger into the container because the opening is larger. The same is true as the stiffness decreases. Although the rubber-like material can take many forms, a sheet form is suitable because it is readily made for commercial purposes.

In an effort to quantify the properties of the rubber-like material or sheet, the relevant properties can be described in terms of the hardness, stiffness, thickness, elasticity and any combination thereof.

More specifically, the Shore A hardness (as measured by ASTM D2240) of the flexible, rubber-like sheet or material can be about 100 or less, more specifically from about 20 to about 70, and still more specifically from about 30 to about 60.

The Gurley stiffness of the flexible, rubber-like sheet or material (as measured by ASTM D 6125-97 "Standard Test Method for Bending Resistance of Paper and Paperboard") can be about 10,000 milligrams of force (mgf) or less, more specifically from about 100 to about 8000 mgf, more specifically from about 200 to about 6500 mgf, and still more specifically from about 300 to about 1500 mgf.

The thickness of the flexible, rubber-like sheet can be about 0.1 millimeter or greater, more specifically from about 0.1 to about 2 millimeters, and still more specifically from about 0.8 to about 1.5 millimeters.

The elasticity of the flexible rubber-like material or sheet, as characterized by the tensile stress at 100 percent elongation and measured in accordance with ASTM D412 "Standard Test Methods for Vulcanized Rubber and Thermoplastic Elastomers", can be about 10 megapascals (Mpa) or less, more specifically from about 0.1 to about 7 Mpa, and still more specifically from about 0.5 to about 2.5 Mpa.

Alternatively, the performance of the dispensing means can be measured more directly by using a tensile testing machine to insert a ball-shaped probe into the dispensing opening under controlled conditions and measuring the force required to overcome the resistance of the opening . This simulates the use of one's finger to reach into the container to retrieve a wipe. In general, the measurement involves placing a container to be tested underneath a specially-designed probe which is mounted to a tensile tester . The tensile tester lowers the probe into the center of the container dispensing means at a predetermined speed and measures the peak load, in grams, required to penetrate the opening. This test, as more specifically described below, results in a value referred to herein as the "Penetration Index". The containers of this invention can have a Penetration Index of from about 50 to about 600 grams, more specifically from about 100 to about 500 grams, and still more specifically from about 200 to about 400 grams.

The tensile tester is a MTS Sintech 1/G with a MTS 10 pound load cell. The software is Testwrorks for Windows 3.10. The load cell contains a 0.5 inch grip adapter for receiving the metal ball probe. The ball probe used is approximately 4.5 inches long. The bottom portion of the probe, which contacts the sample to be tested, is ball-shaped and has a ball diameter of 0.75 inch. The middle portion of the probe consists of a connecting "neck" which is approximately 0.375 inches in diameter and 1.375 inches long. The upper section of the probe is approximately 0.5 inch in diameter and 2.4 inches long. The end of the upper section contains a flat area to allow the probe to fit into the grip adapter of the tensile tester. The flat area is 0.125 inch off of the center of the probe.

When conducting the test, the container to be tested is securely placed on a suitable surface such that the center of the dispensing opening is placed directly underneath the ball probe. The probe is initially positioned such that it is approximately one inch above the dispensing opening. Upon the start of the test, the probe moves downward at a rate of 80 inches per minute for a distance of 2 inches. The probe is held for one second at this bottom position and then is moved upward to its initial position at the same rate. The test is repeated two additional times. The peak load readings from the tensile tester, expressed as grams of force, are averaged and the result is the Penetration Index for the sample.

As used herein, the term "rigid" is used to mean a level of stiffness commonly associated with materials used to manufacture wet wipes tubs. Numerically, these materials typically have a flexural modulus (as measured in accordance with ASTM D790 "Standard Test Method for Flexural Properties of Unreinforced and Reinforced Plastics and Electrical Insulating Materials") of about 500 Newtons per square millimeter or greater, more specifically from about 1100 to about 1550 Newtons per square millimeter.

The term "interfolded wipes", as used herein, means a plurality of wipes, such as in a stack of wipes, in which separate individual wipes are releasably attached to each other by folding an edge of one wipe over the edge of an adjacent wipe.

The term "perforated wipes", as used herein, means a plurality of wipes, such as in a stack or roll, in which individual wipes are defined and interconnected by a series of perforation lines in a continuous sheet, such that each wipe can be detached from the remaining wipes by tearing the sheet along the line of perforations.

Both interfolded wipes and perforated wipes can be used for purposes of this invention.

DETAILED DESCRIPTION OF THE DRAWINGS

Figure 1:
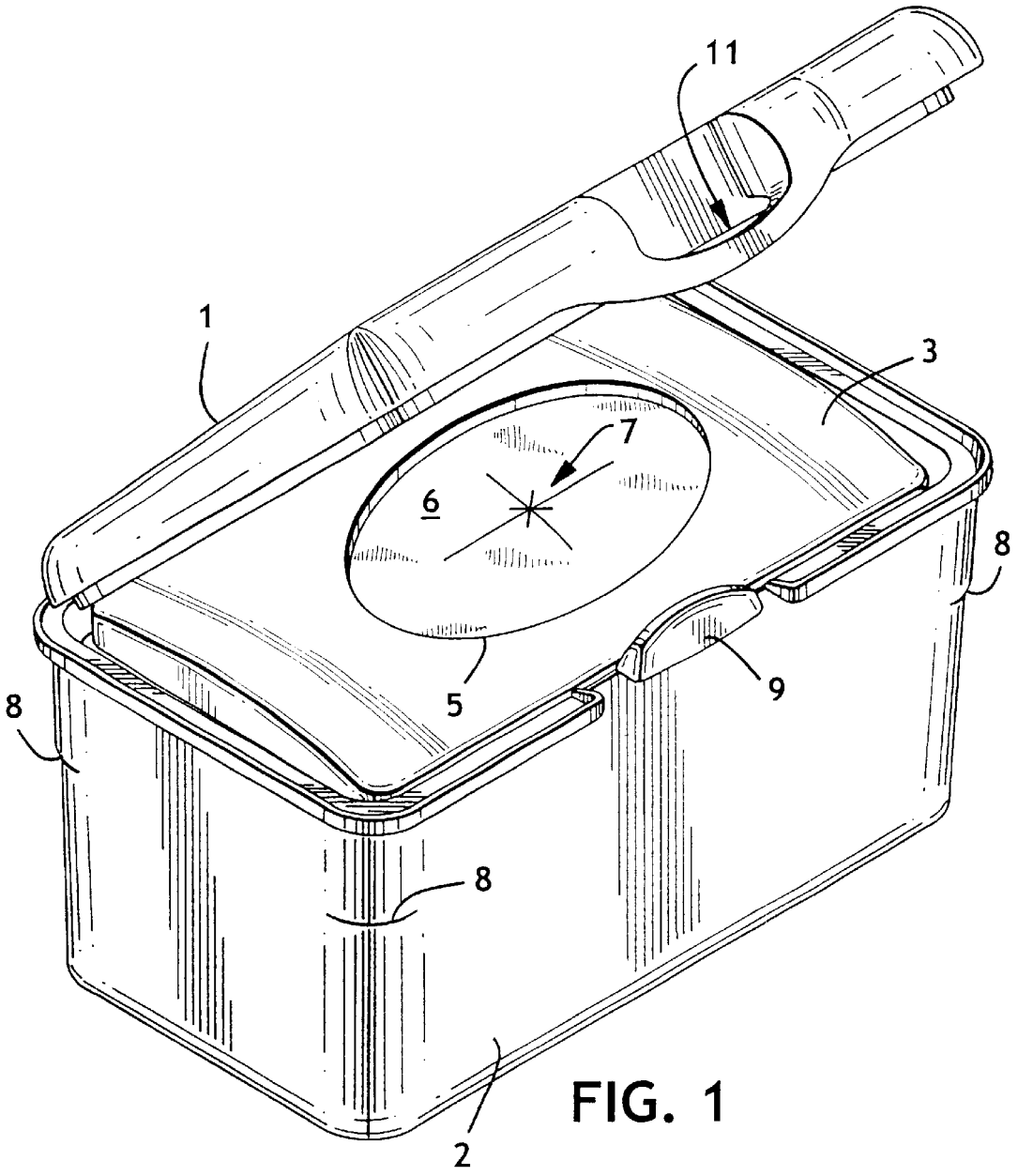
FIG. 1 is a perspective view of one embodiment of a wet wipe container in accordance with this invention with the lid open, illustrating the placement of the dispensing means within a removable inner cover.

Referring to FIG. 1, the invention will be described in greater detail. Shown is a rigid plastic wet wipe container having a lid 1 hingedly attached to a base 2 and a removable inner cover 3. The removable inner cover contains a pop-up style dispensing means comprising a rigid port 5 which surrounds a flexible, rubber-like material or sheet 6 having several slits 7 through which individual wet wipes are removed from the container. The removable inner cover shown is somewhat dome-shaped with a slight pitch toward the front of the container. It is removably secured to the sidewalls of the base by a small lip around the periphery of the inner cover that engages with notches within several protruding ribs on the inner surface of the sidewalls (not shown). It also rests on a small support surface in each of the four corners of the base, which is outwardly visible by discontinuities 8 in the rounded corners of the base. The lid is secured in a closed position by a suitable latching mechanism, in which a protrusion 9 in the front lip of the base is engaged by an opening 11 in the front lip of the lid.

The shape of the rigid port in the embodiment shown in FIG. 1 is oval, but can be any shape and size large enough to enable the user to reach into the container with their fingers to grasp the next available wet wipe in the event of a dispensing failure. Other suitable shapes include, without limitation, square, rectangular, circular, triangular and irregular. The area of the oval illustrated in the container of FIG. 1 is about 6 square inches.

The slits in the flexible, rubber-like sheet as shown are star-shaped. The longest slit is about 1.75 inches and the smaller slits are about 0.25 inch. However, many other slit configurations are also suitable including, without limitation, X-shaped slits, straight slits and curvilinear slits. The length of the individual slits can be about 0.25 inch to about 3 inches, more specifically from about 0.25 inch to about 2 inches. The length of the slits will in part depend upon the slit configuration and the number of slits. The sum total length for all of the slits in the sheet or material can be about 2.5 inches or greater. It is preferred to have at least one slit with a length of about 1 inch which, in combination with the elasticity of the rubber-like sheet or material, will allow the user to reach into the container with at least two fingers as necessary. For very tall containers, it may be necessary to lengthen at least one of the slits so that the user can still reach the bottom of the container. For such a container, at least one of the slits may need to be between 2 and 6 inches in length, more specifically between 3 and 4 inches in length. This will allow the user to insert one or more fingers as well as part of the hand into the container to retrieve a wipe.

Figure 2:
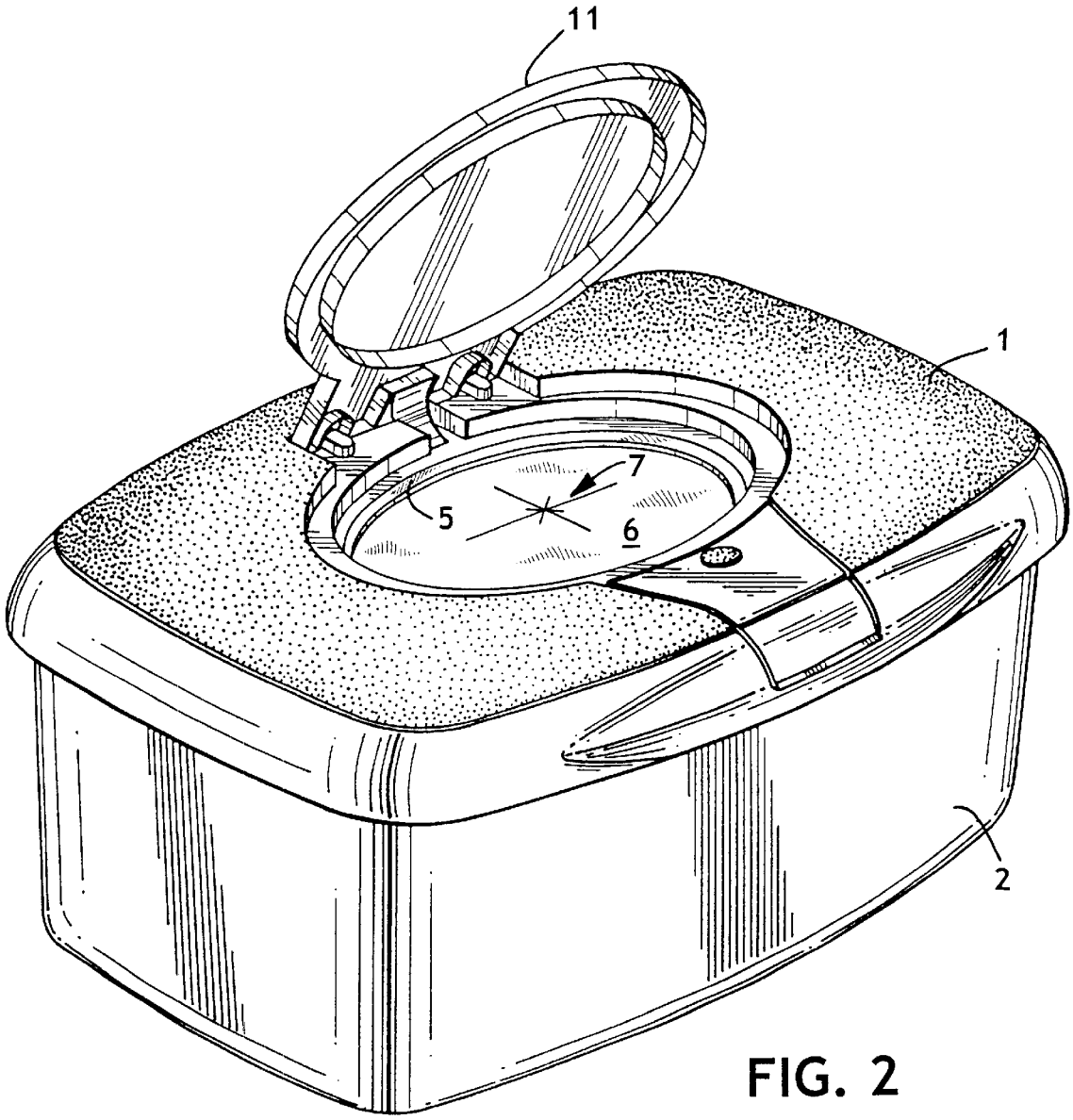
FIG. 2 is a perspective view of another embodiment of a wet wipe container of this invention, with the lid open, wherein the dispensing means is recessed within the rigid top of the container.

FIG. 2 is a perspective view of another rigid plastic container in accordance with this invention, in which the pop-up style dispensing means is recessed within the lid of the container. Shown is a removable lid 1, a base 2, a rigid port 5 which surrounds a flexible, rubber-like sheet 6 having several slits 7 through which the wet wipes are dispensed. This container also has a pop-up lid 11 which can be closed to seal the container when not in use.

Figure 3:
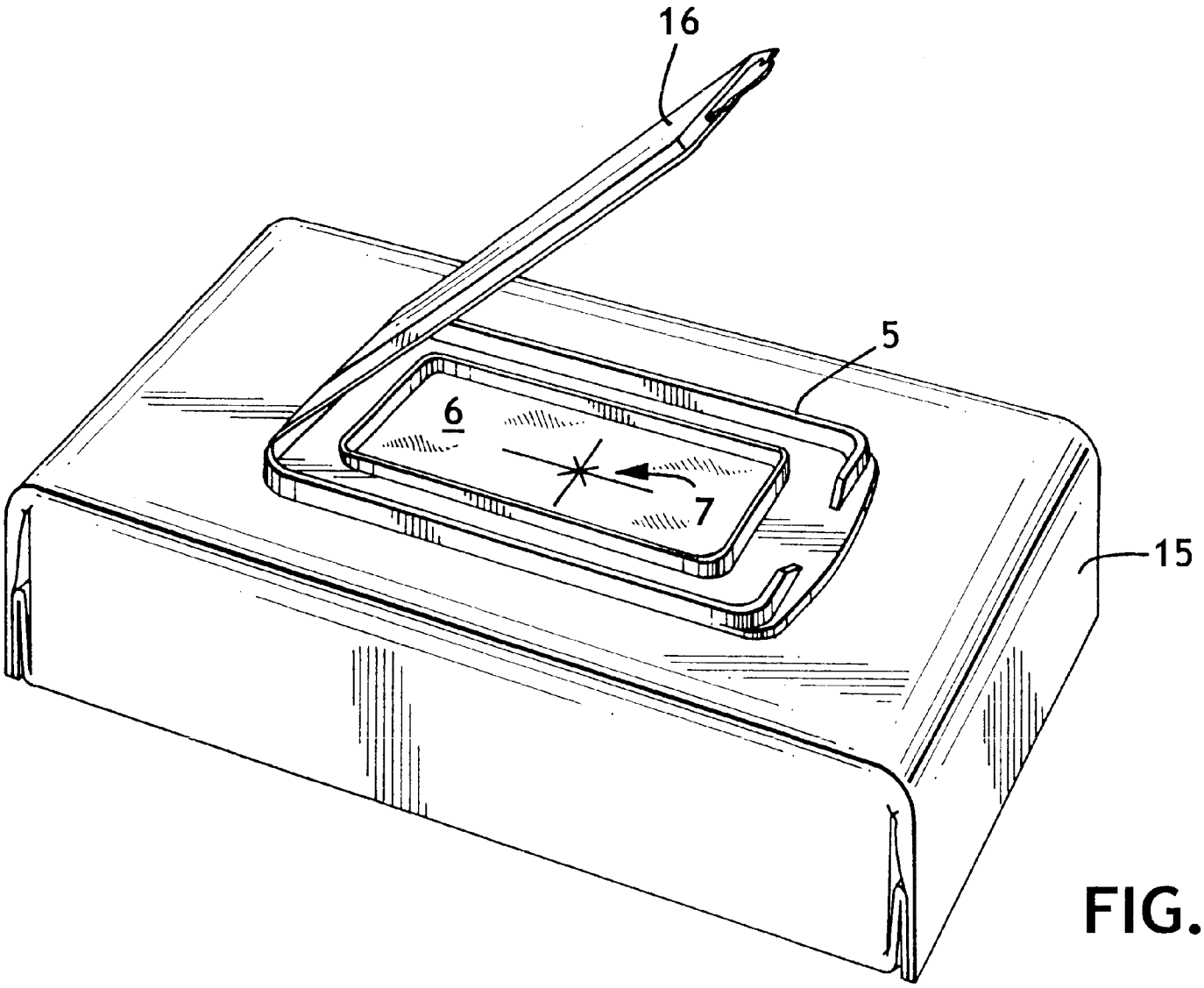
FIG. 3 is a perspective view of another embodiment of a wet wipe container of this invention, wherein the dispensing means is attached to a flexible container package.

FIG. 3 is a perspective view of another container in accordance with this invention, in which the container is a flexible package, such as a plastic film-wrapped package, having a flip-top style dispensing opening. Shown is the flexible plastic film package 15 which contains a stack of wet wipes. A dispensing means is provided on the top of the package, which dispensing means comprises a rigid port 5 surrounding a flexible, rubber-like sheet having one or more slits 7 through which the wet wipes are removed from the package. The flip-top lid 16 can be closed over the rigid port to seal off the container when not being used. Any suitable closure design can be used to effect a proper seal.

While the dispensing means useful for purposes of this invention has been specifically illustrated in three different styles of container, those skilled in the art will appreciate that many different container designs are possible, including canister style containers, without departing from the scope of the invention.

It will be appreciated that the foregoing description, given for purposes of illustration, is not to be construed as limiting the scope of the invention, which is defined by the following claims and all equivalents thereto.

We claim:

1. A wet wipe container containing interfolded or perforated wet wipes and having a pop-up style dispensing means positioned beneath a retractable lid, said dispensing means comprising a rigid port surrounding a flexible, rubber-like material or sheet having one or more slits through which individual wet wipes are removed from the container when the lid is open, wherein the flexibility of the sheet and the length of the slit(s), in combination, are sufficient to enable a user to reach into the container and retrieve a wet wipe in the event the pop-up feature fails and wherein the dispensing means has a Penetration Index of from about 50 to about 600 grams.

2. The container of claim 1 wherein the wet wipes are contained within a flexible package.

3. The container of claim 1 wherein the wet wipes are contained within a rigid tub.

4. The container of claim 1 wherein the flexible, rubber-like sheet or material has a Shore A hardness of about 100 or less.

5. The container of claim 1 wherein the flexible, rubber-like sheet or material has a Gurley stiffness of about 10,000 mgf or less.

6. The container of claim 1 wherein the flexible, rubber-like sheet or material has a thickness of about 0.1 millimeter or greater.

7. The container of claim 1 wherein the flexible, rubber-like sheet or material has an elasticity of about 10 Mpa or less.

8. The container of claim 1 wherein at least one slit has a length of about 1 inch or greater.

9. The container of claim 1 or 6 having four, commonly intersecting slits which create a "star-shaped" slit configuration.

10. The container of claim 1 having a rigid base and a rigid lid, wherein the pop-up style dispensing means is recessed within the rigid lid.

11. The container of claim 1 wherein the Penetration Index is from about 100 to about 500 grams.

12. The container of claim 1 wherein the Penetration Index is from about 200 to about 400 grams.

13. A wet wipe container containing interfolded or perforated wet wipes and having a pop-up style dispensing means positioned beneath a retractable lid, said conatiner having a rigid base and a hinged rigid lid, said container further comprising a removable rigid inner cover which covers the stack of wipes within the container and which contains the pop-up style dispensing means, said dispensing means comprising a rigid port surrounding a flexible, rubber-like material or sheet having one or more slits through which individual wet wipes are removed from the container when the lid is open, wherein the flexibility of the sheet and the length of the slit(s), in combination, are sufficient to enable a user to reach into the container and retrieve a wet wipe in the event the pop-up feature fails and wherein the dispensing means has a Penetration Index of from about 50 to about 600 grams.

14. The container of claim 13 wherein the Penetration Index is from about 100 to about 500 grams.

15. The container of claim 13 wherein the Penetration Index is from about 200 to about 400 grams.

* * * * *

UNITED STATES PATENT AND TRADEMARK OFFICE

CERTIFICATE OF CORRECTION

PATENT NO. : 6,523,690 B1 
DATED : February 25, 2003
INVENTOR(S) : Frederick Allan Buck et al.

It is certified that error appears in the above-identified patent and that said Letters Patent is hereby corrected as shown below:

Title page,
Item [75], Inventors, insert
-- ; Craig Martin Saunders -- after "John David Amundson, Crawley (GB)".

Signed and Sealed this

Seventeenth Day of June, 2003

JAMES E. ROGAN
*Director of the United States Patent and Trademark Office*